US006062913A

United States Patent [19]

Puerner

[11] Patent Number: 6,062,913

[45] Date of Patent: May 16, 2000

[54] ELECTRICAL CONNECTOR AND METHOD OF MAKING THE SAME

[75] Inventor: Dean Arnold Puerner, Maricopa, Ark.

[73] Assignee: The Whitaker Corporation, Wilmington, Del.

[21] Appl. No.: 09/098,046

[22] Filed: Jun. 16, 1998

[51] Int. Cl.[7] ..... H01R 13/502

[52] U.S. Cl. ..... 439/687

[58] Field of Search ..... 439/687, 731, 439/884, 891, 885, 843, 701; 29/876

[56] References Cited

U.S. PATENT DOCUMENTS

| | | | |
|---|---|---|---|
| 2,223,231 | 11/1940 | Smith | 439/687 |
| 2,443,797 | 6/1948 | Miller | 439/687 |
| 3,439,313 | 4/1969 | Fischer | 439/687 |
| 4,013,329 | 3/1977 | Hugin | 339/9 E |
| 4,822,961 | 4/1989 | Hugin et al. | 200/16 R |
| 5,449,304 | 9/1995 | Huss, Jr. et al. | 439/843 |

*Primary Examiner*—Neil Abrams
*Assistant Examiner*—Javad Nasri

[57] ABSTRACT

An electrical connector (1) having multiple electrical contacts (2) encircled by an insulating housing (3) wherein, each of the electrical contacts (2) is divided into lengthwise halves (4), and the housing (3) is formed by separate housing halves (5), and the electrical connector (1) is provided by combining together the housing halves (5), and combining together the lengthwise halves (4) of each of the electrical contacts (3).

13 Claims, 2 Drawing Sheets

ELECTRICAL CONNECTOR AND METHOD OF MAKING THE SAME

FIELD OF THE INVENTION

The invention relates to an electrical connector assembly having multiple electrical contacts within an insulating housing.

BACKGROUND OF THE INVENTION

A known electrical connector, described by U.S. Pat. No. 5,449,304, has multiple electrical contacts in an insulating housing. The insulating housing is fabricated separately from each of the electrical contacts. Each of the electrical contacts is fabricated as a single piece. Each of the electrical contacts is assembled along a corresponding passage in the insulating housing. Cylindrical band contact elements, known from U.S. Pat. Nos. 4,013,329 and 4,822,961, are in respective open ends of the electrical contacts.

The known electrical connector has the disadvantage of requiring insertion of the electrical contacts along corresponding passages in the insulating housing. The insulating housing is required to have interlocking features that interlock with the electrical contacts to resist withdrawal of the electrical contacts from the passages. Difficulties arise from a requirement to fully insert the electrical contacts in the passages in correct positions to interlock with the insulating housing.

SUMMARY OF THE INVENTION

The invention relates to an electrical connector wherein an insulating housing is fabricated as housing halves directly against lengthwise halves of each of the electrical contacts. The housing halves are combined together to combine together the lengthwise halves of respective electrical contacts. The housing of the electrical connector comprises the combined housing halves. The electrical contacts of the electrical connector comprises the held together halves of respective electrical contacts.

DESCRIPTION OF THE DRAWINGS

An embodiment of the invention will now be described by way of example with reference to the accompanying drawings, according to which.

DETAILED DESCRIPTION

Figure 1:
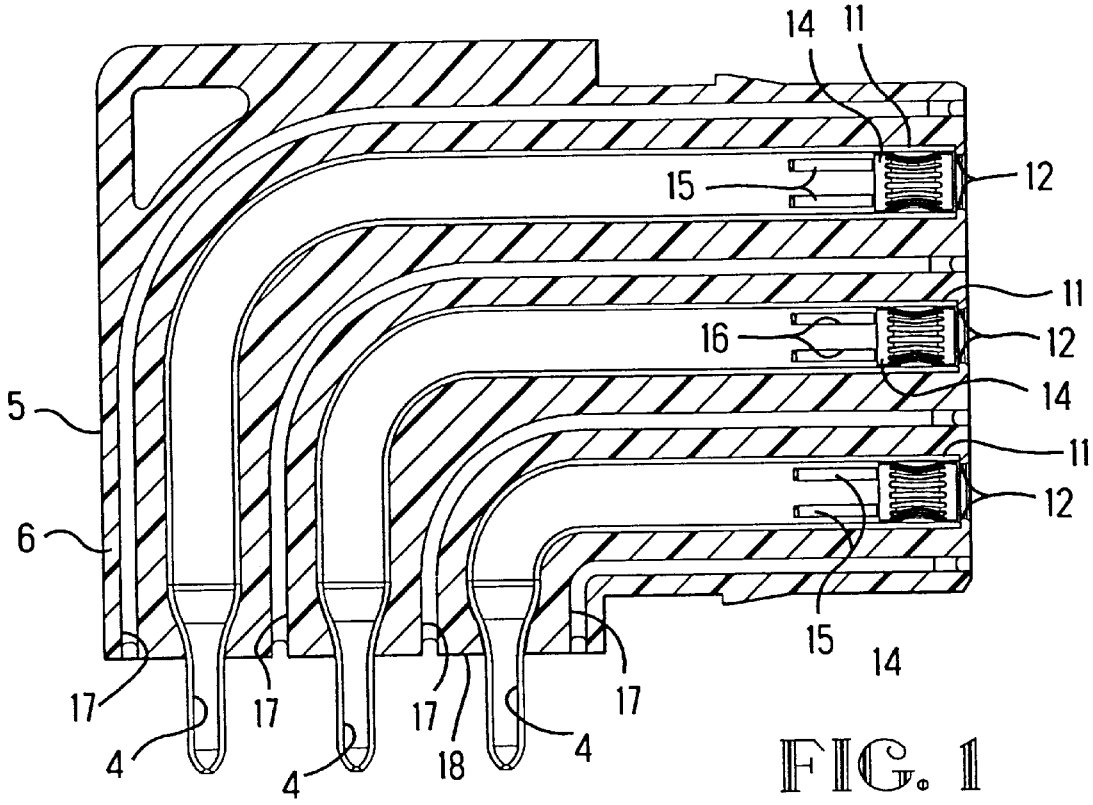
FIG. 1 is a side view of one of the housing halves of an insulating housing, as shown in FIG. 3, together with lengthwise halves of each electrical contact, as shown in FIG. 3.
Figure 3:
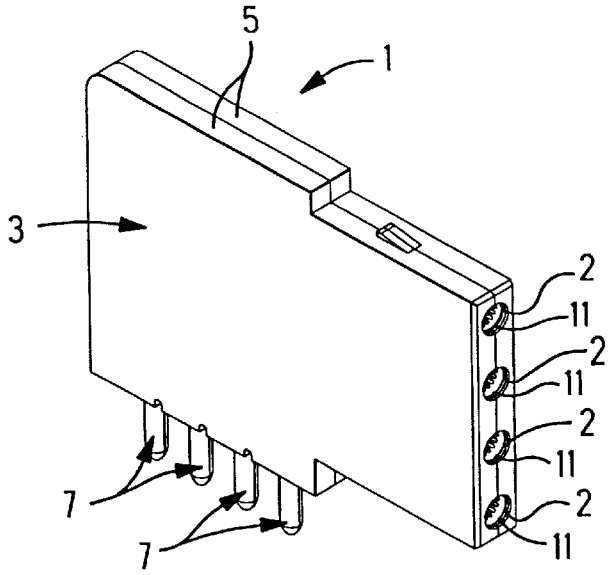
FIG. 3 is an isometric view of an electrical connector having multiple electrical contacts encircled by an insulating housing.
Figure 4:
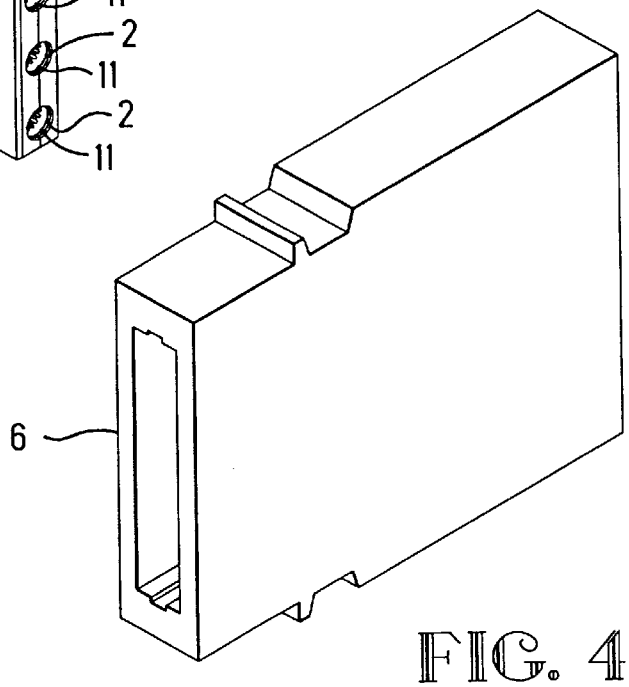
FIG. 4 is an isometric view of a hollow shell.

With reference to FIG. 3, an electrical connector 1 has multiple electrical contacts 2 encircled by an insulating housing 3. With reference to FIG. 1, a method of making the electrical connector 1 comprises a method step of fabricating each of the electrical contacts 2 in lengthwise halves 4. The lengthwise halves 4 are later combined to form each of the electrical contacts 2. The method further includes the method step of, forming the housing 3 in separate housing halves 5, with each of the halves 5 of the housing 3 being formed directly against one of the lengthwise halves 4 of each of the electrical contacts 2. For example, each of the housing halves 5 is formed according to a known, injection molding process. The known, injection molding process will now be briefly described. The lengthwise halves 4 of the electrical contacts 2 are positioned in a cavity of a known molding die, not shown. Fluent insulating material is injected into the cavity, and flows to fill the cavity and to conform to the exteriors of the lengthwise halves 4 of the electrical contacts 2. The fluent insulating material forms into a unitary one of the housing halves 5. Each unitary one of the housing halves 5 has an imbedded one of the lengthwise halves 4 of each of the electrical contacts 2. The imbedded lengthwise halves 4 of the electrical contacts 2 are held in their desired positions relative to the unitary one of the housing halves 5, and are along a surface 6 that is exposed on the unitary one of the housing halves 5. The difficulties associated with insertion of the contacts 2 along cavities of the housing are avoided. The relative cost of fabricating the electrical contacts 2 in lengthwise halves is reduced as compared to the relative cost of fabricating each of the electrical contacts 2 as a whole, by either, machining, or by stamping and forming the electrical contacts 2 with hollow interiors.

Figure 2:
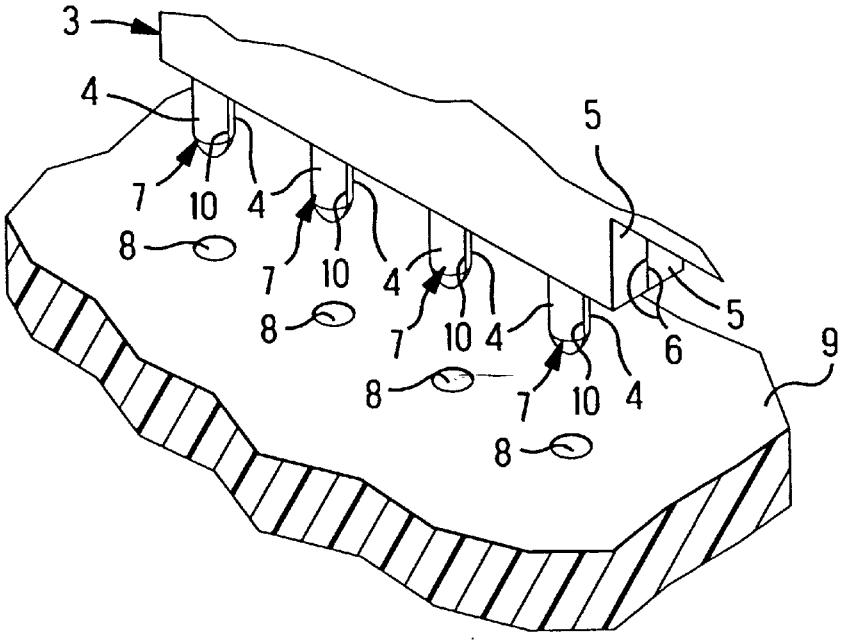
FIG. 2 is a diagrammatic view of a portion of an electrical connector as shown in FIG. 3, together with plating lined apertures of a circuit board.

The method further includes the method step of, forming the electrical connector 1 by combining together the housing halves 5, for example, along their surfaces 6, and combining together the lengthwise halves 4 of each of the electrical contacts 2. As shown in FIGS. 2 and 3, the housing 3 has combined housing halves 5. The combined housing halves 5 position the lengthwise halves 4 of each of the electrical contacts 2 to abut each other, FIGS. 2 and 3. Each of the electrical contacts 2 is formed by its combined lengthwise halves 4, FIG. 2.

Figure 5:
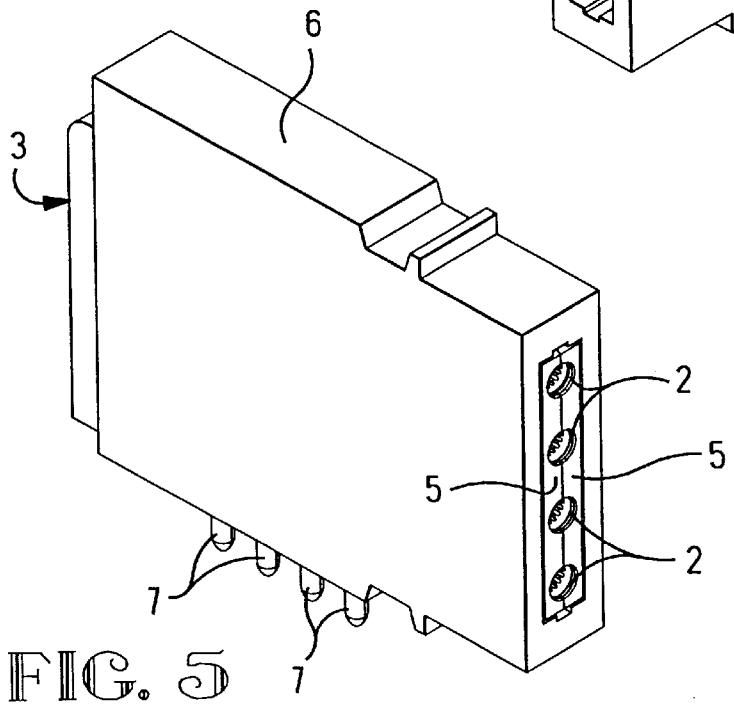
FIG. 5 is an isometric view of the hollow shell, as shown in FIG. 4, encircling the electrical connector as shown in FIG. 3.

With reference to FIG. 5, the combined housing halves 5 can be held together, for example, by fitting within an encircling hollow shell 6' of insulation material or, alternatively, conducting material. Holding the combined housing halves 5 together holds together the combined lengthwise halves 4 of each of the electrical contacts 2.

The lengthwise halves 4 of each of the electrical contacts 2 emerge from the housing halves 5 to provide known electrical terminals 7 for electrical connection by solder joints with conductive lining within apertures 8 through a known circuit board 9. For example, the lengthwise halves 4 of each of the electrical contacts 2 become electrically connected together by such solder connections.

When it is desired that the lengthwise halves 4 become electrically connected together before connection to a circuit board 9, connecting the lengthwise halves 4 together is accomplished, for example, by welding them together, as shown in FIG. 2, to provide a weld joint 10 where they emerge from the housing halves 5, or by soldering them together to provide a solder joint 10 where they emerge from the housing halves 5.

With reference to FIG. 1, it is desirable to provide lengthy voltage creepage paths and increased voltage clearance distances in front of respective mating ends 11 of the electrical contacts 2, by forming each of the housing halves 5 with radially inward, protruding lip portions 12 that overlap the mating ends 11 on said lengthwise halves 4 of the electrical contacts 2. For example, the lip portions 12 are unitary with the remainder of the respective housing halves 5. When the housing halves 5 are combined, the lip portions 12 overlap the mating ends 11 of each of the electrical contacts 2, and are joined together, for example, by welding. Welding is accomplished by ultrasonic welding, according to a known ultrasonic wave form generating apparatus. The combined lip portions 12 overlapping each of the electrical contacts 2 provide seamless insulating voltage creepage and clearance paths that overlap said mating ends 11.

The mating ends 11 of the electrical contacts 2 comprise respective electrical receptacles. For simplicity and ease of manufacture, the lengthwise halves 4 of each of the contacts 2 are hollow along their lengths. When combined together, the hollow portions of the lengthwise halves 4 provide the mating ends 11 of the electrical contacts 2 as being open. At their opposite ends, the lengthwise halves 4 combine to provide closed ends on the terminals 7 that are tapered for ease in insertion into the plating lined apertures 8 of the circuit board 9.

With reference to FIG. 1, band contacts 14 that are resiliently expansible are inserted in the open mating ends 11 of said combined lengthwise halves 4. For purposes of illustration, the band contacts 14 are shown in FIG. 1 with one of the lengthwise halves 4 of each of the electrical contacts 2. Each of the band contacts 14 is a conductive, open cylindrical, resilient spring that is known from U.S. Pat. No. 5,449,304, incorporated herein by reference. Each of the band contacts 14 is formed as a lengthwise band of material comprising a development of a split cylinder. The split cylinder is resiliently collapsible, radially, to pass into the mating end 11 of a corresponding electrical contact 2. Once inside the mating end 11 of the electrical contact 2 the split cylinder expands resiliently. The presence of the lip 12 overlapping the mating end 11 of the corresponding electrical contact 2 prevent withdrawal of the expanded split cylinder from the electrical contact 2.

With reference to FIG. 1, each of the housing halves 5 is formed with unitary insulating interlocking portions 15 that interlock with the corresponding lengthwise halves 4 of the electrical contacts 2. For example, openings 16 are provided through the thickness of each of the lengthwise halves 4. During formation of the unitary housing halves 5, fluent insulating material injects into the openings 16, and subsequently solidifies to form the interlocking portions 15. The interlocking portions 15 are spaced from the mating ends 11 of the electrical contacts 2. The band contacts 14 register against the interlocking portions 15 and the lip portions 12 to resist movement of the band contacts 14 longitudinally of the electrical contacts 2.

It is desirable to provide lengthy voltage creepage paths along a seam that extends along the facing surfaces 6 of the combined housing halves 5, which will avoid electrical shorting among the electrical contacts 2. Along the seam, as shown in FIG. 1, unitary recessed channels 17 are formed in at least one of the housing halves 5. The combined housing halves 5 are joined together, for example, by welding along the respective channels 17 in the seam.

Welding of the housing halves 5 and welding of the lengthwise halves 3 of the electrical contacts 2, is accomplished by ultrasonic welding, according to a known ultrasonic wave form generating apparatus. Ultrasonic wave forms are directed along the channels 17 in the seam to melt the corresponding housing half 5 adjacent to each of the channels 17, and to provide a melted, fusible weldment material that forms weld joints that join the housing halves 5 together along the seam. The channels 17 open into at least one end of the corresponding housing half 5, into which channels 17 the ultrasonic energy is directed for transmission along the lengths of the channels 17. The channels 17 separate the electrical contacts 2 from one another. The electrical contacts 2 are separated from one another by the weld joints that join together the housing halves 5 along the seam. The weld joints avoid electrical shorting from one of the electrical contacts 2 to another. Closing of the seam along each of the weld joints electrically isolates the electrical contacts 2 from one another.

Other embodiments and modifications of the invention are intended to be covered by the spirit and scope of the appended claims.

What is claimed is:

1. A method of making an electrical connector having respective electrical contacts in a housing, the method comprising the steps of:

forming the respective electrical contacts in lengthwise halves, imbedding the lengthwise halves in respective housing halves of a housing, with the lengthwise halves emerging from the respective housing halves, and with the lengthwise halves extending along respective surfaces on the respective housing halves prior to joining the lengthwise halves to comprise the respective electrical contacts, abutting the lengthwise halves of the respective electrical contacts by bringing the housing halves together along the respective surfaces to provide the housing, and joining the lengthwise halves of the respective electrical contacts where they emerge from the respective housing halves.

2. A method as recited in claim 1, and further comprising the step of: inserting respective band contacts into ends of the respective electrical contacts.

3. A method as recited in claim 1, and further comprising the step of: holding the respective housing halves together along the respective surfaces by fitting the respective housing halves in an encircling hollow shell.

4. A method as recited in claim 1, and further comprising the steps of:

providing voltage creepage paths by providing channels in the respective surfaces, said channels are beside the lengthwise halves, and following the step of, abutting the lengthwise halves of the respective electrical contacts by bringing the housing halves together along the respective surfaces to provide the housing, welding the respective housing halves adjacent to the channels.

5. A method as recited in claim 1, wherein the step of imbedding the lengthwise halves in respective housing halves of a housing, further comprises the step of, forming interlocking portions on the respective housing halves that interlock with the lengthwise halves.

6. A method as recited in claim 1, wherein the step of imbedding the lengthwise halves in respective housing halves of a housing, further comprises the step of, forming radially inward lips on the respective housing halves that overlap ends of the lengthwise halves to provide voltage creepage paths, and further comprising the steps of:

joining the radially inward lips on the respective housing halves after abutting the lengthwise halves of the respective electrical contacts by bringing the housing halves together along the respective surfaces to provide the housing, and inserting respective band contacts into the ends of the lengthwise halves after abutting the lengthwise halves of the respective electrical contacts by bringing the housing halves together along the respective surfaces to provide the housing.

7. A method as recited in claim 6, wherein the step of imbedding the lengthwise halves in respective housing halves of a housing, further comprises the step of, forming interlocking portions on the respective housing halves that interlock with the lengthwise halves.

8. A method as recited in claim 1, and further comprising the step of: joining the respective housing halves together along the respective surfaces.

9. A method as recited in claim 8, wherein the step of joining the respective housing halves together along the respective surfaces, further comprises the step of, ultrasonic welding the respective housing halves to join the respective housing halves together.

10. An electrical connector comprising: electrical contacts provided by lengthwise halves, the lengthwise halves being imbedded in separate housing halves, the separate housing halves being molded directly against the lengthwise halves, the lengthwise halves extending along respective surfaces on the separate housing halves, the lengthwise halves being brought together in abutment by having the separate housing halves being positioned together along the respective surfaces, the lengthwise halves in abutment provide the electrical contacts, and the separate housing halves being held together by an encircling hollow shell.

11. An electrical connector as recited in claim 10, and further comprising: band contacts inserted into the electrical contacts that have been provided by the lengthwise halves being brought together in abutment.

12. An electrical connector comprising: electrical contacts provided by lengthwise halves, the lengthwise halves being imbedded in separate housing halves, the separate housing halves being molded directly against the lengthwise halves, the lengthwise halves extending along respective surfaces on the separate housing halves, the lengthwise halves being brought together in abutment by having the separate housing halves being positioned together along the respective surfaces, the lengthwise halves in abutment provide the electrical contacts, and portions of the lengthwise halves being brought together in abutment projecting from the separate housing halves to provide electrical terminals for electrical connection by solder joints.

13. An electrical connector as recited in claim 12, and further comprising: band contacts inserted into the electrical contacts that have been provided by the lengthwise halves being brought together in abutment.

* * * * *